US006820726B1

(12) United States Patent
Ericson et al.

(10) Patent No.: US 6,820,726 B1
(45) Date of Patent: Nov. 23, 2004

(54) TRACTION ENHANCED CONTROLLED PRESSURE FLEXIBLE FLAT TENSION MEMBER TERMINATION DEVICE

(75) Inventors: Richard J. Ericson, Southington, CT (US); Hugh J. O'Donnell, Longmeadow, MA (US); Ary O. Mello, Farmington, CT (US); Dale R. Barrett, Berlin, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/218,989

(22) Filed: Dec. 22, 1998

(51) Int. Cl.[7] ..... B66B 7/08
(52) U.S. Cl. ..... 187/411
(58) Field of Search ..... 24/135 R, 135 A, 24/135 N, 33 M, 135 K, 127, 164, 182, 507; 411/187; 187/411, 412, 414

(56) References Cited

U.S. PATENT DOCUMENTS

| | | | | | |
|---|---|---|---|---|---|
| 216,013 | A | * | 6/1879 | Ida | 24/136 R |
| 421,120 | A | * | 2/1890 | Young | 24/135 N X |
| 966,243 | A | * | 8/1910 | Ritter | 24/135 K |
| 982,742 | A | * | 1/1911 | Piper | 24/135 A |
| 1,164,115 | A | * | 12/1915 | Pearson | 187/254 |
| 1,450,528 | A | * | 4/1923 | Varney | 24/135 R |
| 1,730,197 | A | * | 10/1929 | Elsey | 24/135 R |
| 2,062,653 | A | * | 12/1936 | Hocher | 24/135 A |
| 2,189,671 | A | * | 2/1940 | Mardis | 24/135 A |
| 2,223,389 | A | * | 12/1940 | Schaedler | 24/127 X |
| 2,234,029 | A | * | 3/1941 | Heckendorf | 24/135 A X |
| 2,552,173 | A | * | 5/1951 | Hocher | 24/135 A X |
| 3,052,320 | A | * | 9/1962 | Dardy | 187/411 |
| 3,103,344 | A | * | 9/1963 | Figge | 24/135 N X |
| 4,143,446 | A | * | 3/1979 | Down | 24/135 R |
| 4,388,837 | A | | 6/1983 | Bender | 74/89.2 |
| 4,405,828 | A | * | 9/1983 | Shook | 24/135 R |
| 4,570,753 | A | | 2/1986 | Ohta et al. | |
| 5,435,044 | A | * | 7/1995 | Ida | 24/136 R |
| 5,526,552 | A | | 6/1996 | De Angelis | |
| 5,566,786 | A | | 10/1996 | De Angelis et al. | |
| 5,855,254 | A | | 1/1999 | Blochle | |
| 6,173,872 | B1 | * | 1/2001 | Cohen | 24/507 |

FOREIGN PATENT DOCUMENTS

| | | | | | |
|---|---|---|---|---|---|
| CA | 679268 | | * | 2/1964 | 24/135 A |
| CA | 2154422 | | | 3/1996 | |
| DE | 318110 | | * | 1/1920 | 24/135 R |
| DE | 1010713 | A | * | 1/1920 | 187/411 |
| DE | 589075 | | * | 12/1933 | 187/411 |
| DE | 2136540 | A | * | 12/1933 | 187/411 |
| DE | 613640 | A | * | 5/1935 | 287/411 |
| DE | 115089 | | | 9/1975 | |
| DE | 3623407 | A1 | * | 1/1988 | 187/411 |
| FR | 999585 | | | 11/1949 | |
| GB | 754786 | A | * | 8/1956 | 24/135 A |
| GB | 1 401 197 | | | 7/1975 | |
| GB | 2134209 | A | * | 8/1984 | |
| JP | 8-40669 | A | * | 2/1996 | |
| WO | PCT/FI97/00823 | | | 1/1997 | |
| WO | PCT/FI97/00824 | | | 1/1997 | |

OTHER PUBLICATIONS

PCT Search Report for Ser. No. PCT/US99/03642 dated Jun. 1, 1999.
PCT Search Report for Ser. No. PCT/US99/03642 dated Jun. 1, 1999.
Hannover Fair 1998.

* cited by examiner

*Primary Examiner*—Eileen D. Lillis
*Assistant Examiner*—Thuy V. Tran

(57) ABSTRACT

A tension member termination device optimized for terminating flexible flat tension members, the device including a socket with a compression portion and a bulbous portion and a compression plate on each side of the compression plate on each side of the compression portion fastenable by fasteners extending through all of these feature. The device provides a pathway for the tension member through the device and upon torquing the fasteners reliably secures the tension member while avoiding deleterious pressure and stress therein.

5 Claims, 6 Drawing Sheets

FIG.3
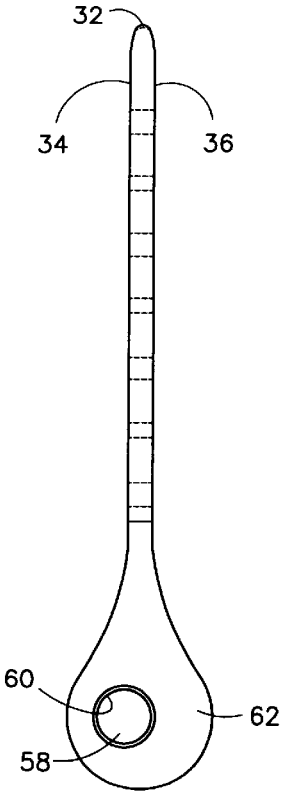
FIG.4
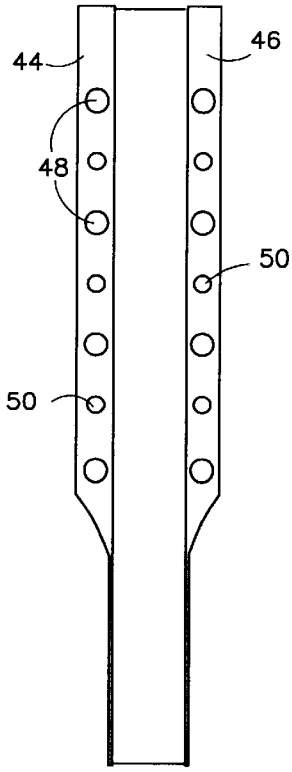
FIG.5
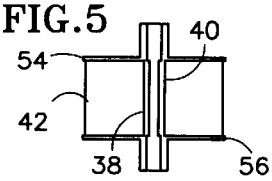
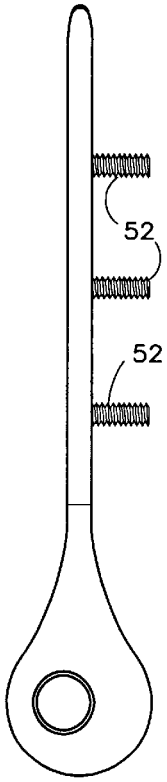
FIG.6
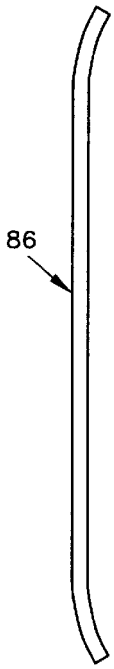
FIG.7
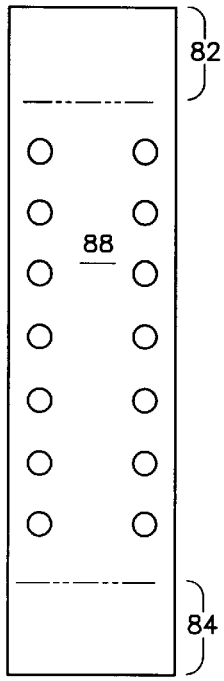
FIG.8

FIG.9
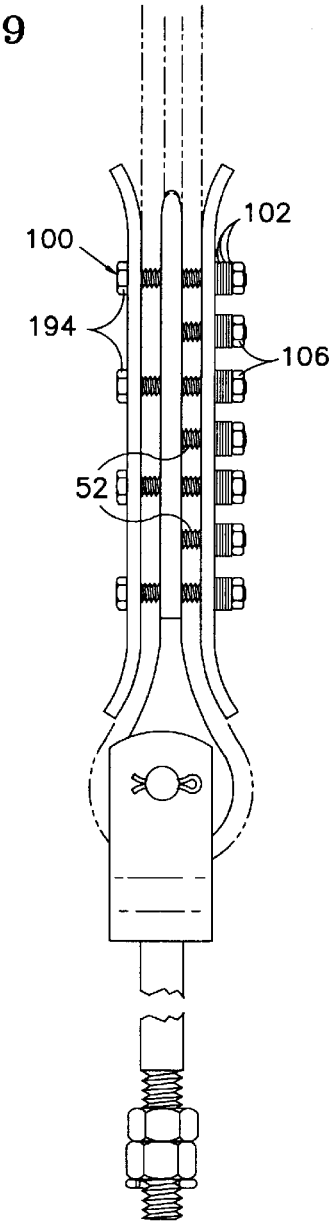
FIG.10
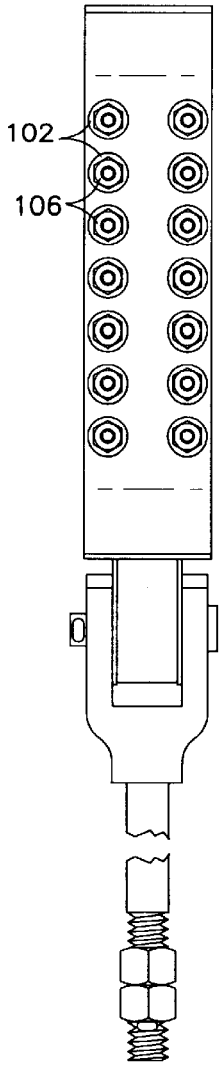
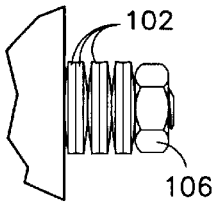
FIG.11
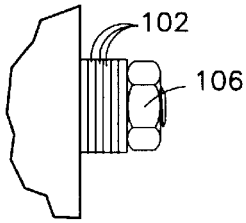
FIG.12
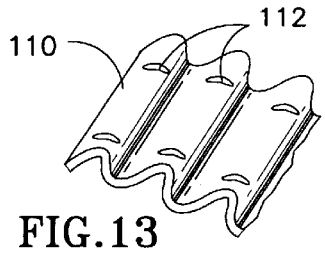
FIG.13

TRACTION ENHANCED CONTROLLED PRESSURE FLEXIBLE FLAT TENSION MEMBER TERMINATION DEVICE

TECHNICAL FIELD

The present invention relates to elevator systems. More particularly the invention relates to a termination for a flexible flat tension member.

BACKGROUND OF THE INVENTION

A conventional traction elevator system includes a car, a counterweight, two or more ropes (tension members) interconnecting the car and counterweights; terminations for each end of the ropes at the connection points with the car and counterweights, a traction sheave to move the ropes and a machine to rotate the traction sheave. The ropes have traditionally been formed of laid or twisted steel wire which are easily and reliably terminated by means such as compression terminations and potted terminations.

Compression type terminations for steel ropes of larger diameters (conventional steel elevator ropes) are extremely effective and reliable. The range of pressures placed on such terminations is reasonably broad without adverse consequence. Providing that the pressure applied is somewhere reasonably above the threshold pressure for retaining the ropes, the termination is effective.

With an industry trend toward flat ropes, those ropes having small cross-section cords and polymeric jackets, significantly more criticality is involved in effectively terminating the same. More specifically, the polymeric coating can creep to even 50% of its original thickness when subjected to pressure. Prior art knowledge which teaches one to exceed a threshold is not all that is of concern for flexible flat tension members. Upper limits on compression are also important.

Since current knowledge in the art of tension member terminations is less than sublime for flexible flat tension members due both to the small cord diameter and the jacket properties discussed above, the art is in need of a tension member terminating device which specifically optimizes terminations of the flexible flat tension members currently emerging in the field.

DISCLOSURE OF THE INVENTION

According to the present invention, a compression termination device having a friction enhancing construction while reducing compressive forces applied to the tension member, comprises a load side plate, a cut side plate and a socket, a portion of which being receivable between said load side and cut side plates and a portion of which is bulb shaped. The plates and socket are of sufficient width to accept a flexible flat tension member of a selected width and are securable together by fasteners. In a condition where the fasteners are loose, the tension member is insertable between the load side plate and socket, toward and around the bulb and back up between the cut side plate and socket whereafter tightening of the fasteners produces significant frictional forces on the tension member to retain the same while compressive forces on the tension member are intentionally limited to about 2 Mpa on the load side of the device and 5 Mpa on the cut side of the device. Friction is increased by texturing the surfaces of the termination device with which the tension member makes contact. With compressive forces as stated, creep is minimized while the termination maintains a sufficient gripping force to provide a factor of safety (fos) of 12 to maintain adequate strength of the termination.

Since creep is a possibility even with Mpa levels at the stated limits, the invention optionally includes a structure providing resilience such that compressive force on the tension member will remain in the acceptable range even if creep does occur.

The termination of the invention further optionally includes a jamming device attachable to the cut end of the tension member. In the unlikely event of tension member slippage through the termination device, the jamming device will be drawn into the termination device and will prevent the tension member cut end from pulling through the termination device.

BRIEF DESCRIPTION OF THE DRAWINGS

FIG. 3 is an end elevation view of a socket of the invention;

FIG. 4 is a side elevation view of a socket of the invention;

FIG. 5 is a top plan elevation view of a socket of the invention;

FIG. 6 is a view similar to FIG. 3 but having studs installed therein;

FIG. 7 is an end elevation view of a compression plate of the invention;

FIG. 8 is a side elevation view of a compression plate of the invention;

FIG. 9 is an end elevation view of the invention in an assembled and torqued condition;

FIG. 10 is a side elevation view of the invention in an assembled and torqued condition;

FIG. 11 is a schematic view of a nut and bolt width belleville washers thereon in the uncompressed condition;

FIG. 12 is a schematic view of a nut and bolt width belleville washers thereon in the compressed condition;

FIG. 13 is a schematic view of an alternate biasing means of the invention;

BEST MODE FOR CARRYING OUT THE INVENTION

Figure 1:
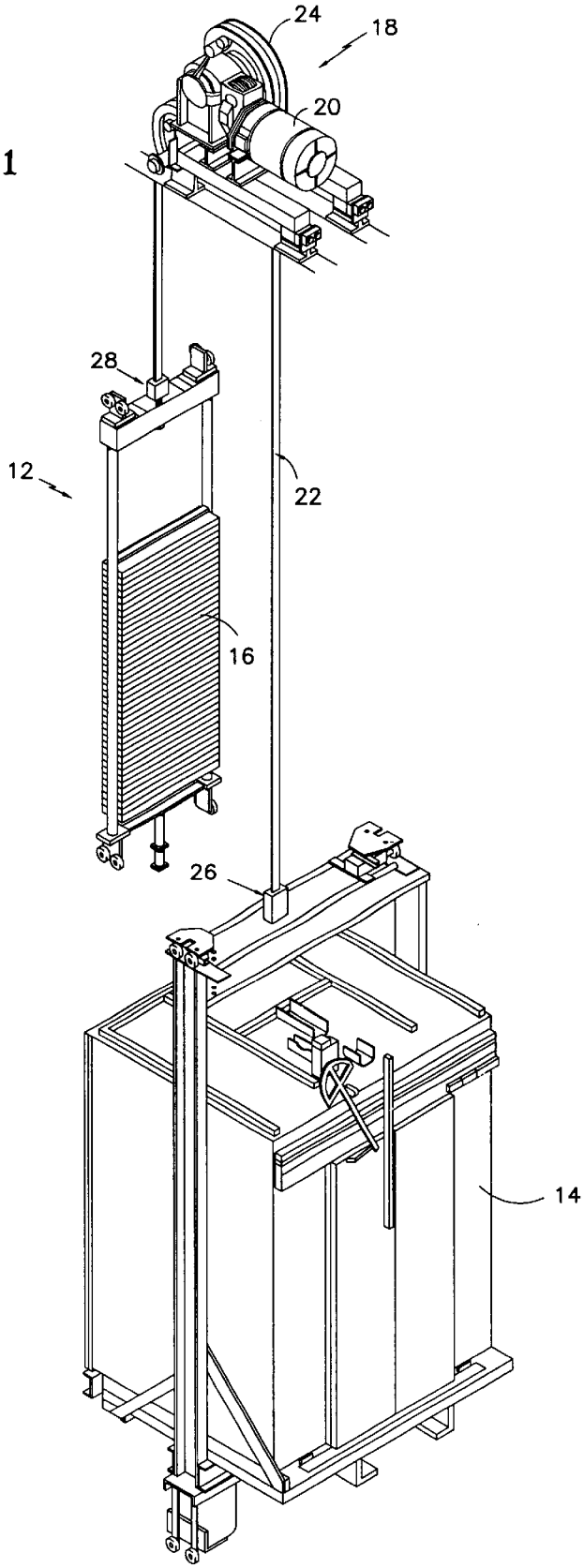
FIG. 1 is a perspective view of an elevator system.

Referring to FIG. 1, the relative location of the tension member termination device of the invention can be ascertained. For clarity, the elevator system 12 is illustrated having car 14, counterweight 16, a traction drive 18 and a machine 20. The traction drive 18 includes a tension member 22 interconnecting car 14 and counterweight 16 which member is driven by sleeve 24. Both ends of tension member 22 i.e., car end 26 and counterweight end 28 must be terminated. It is this termination point for a flexible flat tension member with which the invention is concerned. An exemplary tension member of the type contemplated in this application is discussed in further detail in U.S. Ser. No. 09/031,108 filed Feb. 26, 1998 Entitled Tension Member For An Elevator and Continuation-In-Part Application Entitled Tension Member For An Elevator filed Dec. 22, 1998, both of which are entirely incorporated herein by reference. The elevator system depicted is provided for exemplary purposes to illustrate the location of the device of the invention.

Figure 2:
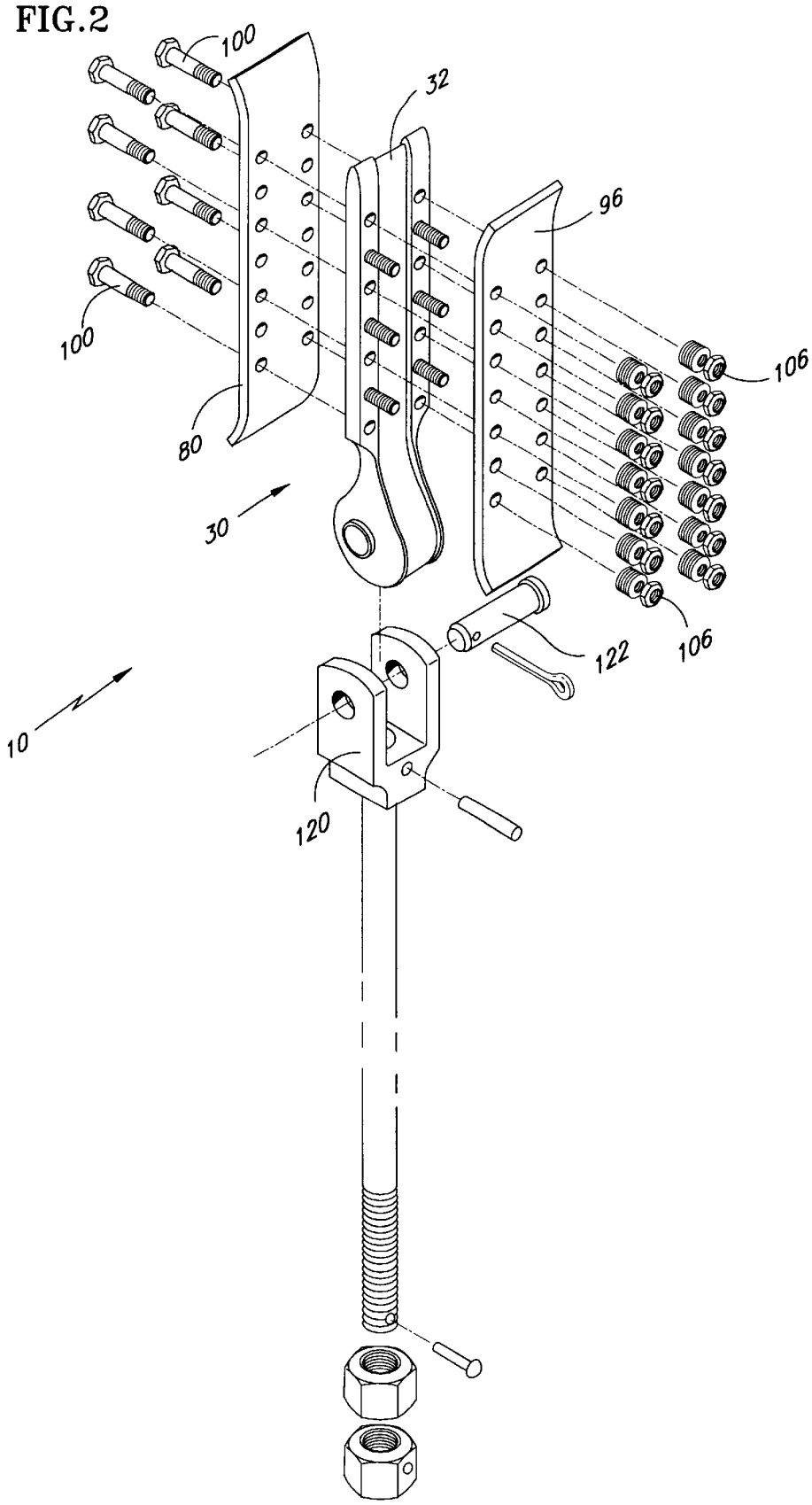
FIG. 2 is an exploded perspective view of the termination device of the invention.

Focusing on the termination device, referring to FIG. 2, and noting that both ends 26 and 28 may be similarly terminated, the device of the invention comprises, principally, a socket 30 around which a flat flexible tension member extends (not shown), a load side plate 80 and a cut side plate 96. The invention further comprises a resilient compression subsystem and a pivoted connector which will be discussed hereinbelow.

Returning to the principal portion of the invention and directing attention to FIGS. 2–5, socket 30 includes a tapered end 32 to both ease insertion of a tension member in the loosely assembled condition of the device and additionally and importantly to avoid a sharp edge which would otherwise promote fatigue in the tension member where the member enters the termination device 10. The taper is from both major surfaces of socket 30 i.e., load surface 34 and cut surface 36. Socket 30 further includes troughs 38 and 40, respectively. Troughs 38 and 40 are sized to receive a tension member of a width that has been pre-selected. Each trough nests with a section of the tension member when the termination device is assembled. Each trough may be left smooth and the termination device will remain effective. It is preferred, however, to texture each trough and the bulb surface 42 thereby increasing the coefficient of friction of all surfaces of socket 30 with which the terminated tension member will make contact. A preferred method for texturing troughs 38 and 40 as well as surface 42 is by sand blasting. It will be understood however that other methods such as machining, chemical etching, etc. could also be used.

Socket 30 further includes binding wings 44 and 46 having a plurality of fastener clearance holes 48 and, in a preferred arrangement, a plurality of stud receiving openings 50. The number of holes 48 depends upon the length socket 30 and the allowable pressure on the tension member. In the embodiment of FIGS. 3 and 4, four holes 48, and three openings 50 are provided on each wing 44 and 46. In a preferred embodiment, openings 50 are threaded to receive studs 52 (FIG. 6). It should be noted that studs 52, as shown in FIG. 6 extend only toward the cut side 36 of socket 30. Studs 52 enable the application of a greater compressive load on cut side 36 of socket 30 than the load applied on load side 34 of socket 30 which is applied by bolts extending completely through device 10. In other words, the load placed on the respective sides of socket 30 (through plates discussed hereunder) by the bolts (which extend through the device) and nuts is approximately equal; studs 52 allow more load to be placed on the cut side as is desirable and explained further hereinafter.

In a preferred embodiment, socket 30 (the section bound between the plates) is about 9 to about 12 millimeters thick to support the stress placed thereon.

Referring back to FIG. 5, surface 42 is illustrated as a depressed area between shoulders 54 and 56. The shoulders are preferably provided to assist in properly seating a tension member when the termination is being constructed. This helps to ensure that the load bearing cords of the tension member do not experience significantly unequal leading. Significant shoulder height is not necessary to achieve the desired result. A height of about 1 millimeter for each shoulder has been found to function adequately.

The final feature of socket 30 is pin receptacle 58 which preferably includes bushing 60 therein. Pin receptacle 58 is located in bulb 62 of socket 30 but is offset from the center axis of bulb 62. More specifically, and to minimize angular stress in the tension member, receptacle 58 is offset toward the load side 34 of socket 30 and is positioned to be aligned on center with a tension member assembled with said termination member. By so locating the receptacle, and thus the pivot point in the system, the load hanging therefrom is aligned with the load side of the tension member engaged with the termination device of the invention.

Socket 30 is important to the functionality of the termination device of the invention principally because it provides three distinct friction zones and a smooth bend surface for the tension member. The combination reduces the compression force required to prevent tension member slippage which is particularly helpful where flexible flat tension members having polymeric jackets are employed. Reducing the compression force that would otherwise be required, alleviates creep and reduces stress in the tension member. This is desirable since it may reduce the number of re-roping operations that would be carried out during the life of the elevator.

Thus far only the socket 30 has been described and it will be apparent to one of ordinary skill in the art that the socket alone does not retain the tension member. Reference is, therefore, made to FIGS. 7 and 8 where the load side and cut side plates 80 and 96, respectively, are described. It should be noted that plate 80 and plate 96 are identical in a preferred embodiment and are provided distinct numerals merely to distinguish each side of the termination device (which is side dependent) rather than to signify any distinction between the plates themselves.

Plates 80 and 96 are curved at longitudinal top 82 and bottom 84 ends thereof. The degree of the curvature is selected to, at end 82, reduce fatigue of the tension member at the point where it enters the termination device. The curve at 82 preferably mirrors the tapered end 32 of socket 30. Bottom end 84 is curved to match the transition from the compression portion of socket 30 to bulb 62. In a preferred embodiment, the curves at 82 and 84 as well as those in the opposite plate 96 are identical so that plates 80 and 96 are interchangeable and orientable in either direction. This facilitates assembly of the termination device.

On the convex side 86 of each plate 80 and 96 (it should be noted that the sub numerals employed to describe features of each plate will be identical because the features are identical and no distinction as to side of the termination device is necessary), a region 88 is provided where a textured surface is desirable. The texture may be of any type that increases the coefficient of friction without being significantly deleterious to the jacket of the tension member. In one preferred embodiment sand blasting of the region is indicated. It will be understood that the region may be textured by machining, chemical etching, knurling, etc. if desired or otherwise indicated. A preferred range of friction for the device of the invention is about 0.15 to about 0.5. Region 88 is outlined in FIG. 8 in phantom lines.

Due to the texturing processes, and especially the sand blasting process, the termination device may become more susceptible to corrosion. In order to avoid or inhibit such corrosion, it has been determined that yellow zinc plating may be advantageously used. Alternatively, stainless steel material or aluminum material may be used for the device of the invention.

Bordering Region 88 on each longitudinal side thereof are a plurality of clearance holes 90. In a preferred embodiment, seven holes 90 are provided on each side of Region 88. Holes 90 accept through passage of bolts to assemble device 10 and also studs 52 discussed with reference to FIG. 6. Although it has been stated that plates 80 and 96 are preferably interchangeable, it is possible to eliminate holes on the load side plate 80 which correspond to studs 52 estimating only from the cut side 36 of socket 30. The holes that can be eliminated may be ascertained by reference to FIG. 9 wherein bolts 100 are illustrated as extending through the entire assembly and studs 52 only extend through one side thereof, therefore only requiring clearance holes 90 in the cut side plate.

Referring to FIGS. 9 and 10, the device 10 is illustrated in the assembled condition with bolts 100 and studs 52 properly torqued. The torque applied is discussed further hereunder but is dictated by the allowed pressure on the tension member which is about 2 Mpa on the load side and about 5 Mpa on the cut side of the termination device 10.

Preferably a biasing arrangement is included in the assembly of device 10, more specifically, it is desirable to anticipate possible creep of the tension member and therefore provide means to maintain the prescribed normal force on the tension member even if it is reduced in thickness by the effects of creep. One such arrangement is illustrated in FIGS. 11 and 12. In FIG. 11, the biasing arrangement of a stack of belleville washers 102 is illustrated the uncompressed state. FIG. 12 on the other hand, illustrates the same stack of washers 102 after torquing of the bolt 100. In the event the volume of material bound between a bolt head 194 and nut 106 (FIG. 9) decreases after torquing, due to creep of the tension member, washers 102 will expand and maintain the pressure on the tension member. The normal pressure on the tension member will thus be maintained. The additional benefit of easy visual inspection for creep is realized by the invention since if the washers exhibit a spaced appearance like that of FIG. 11, retorquing is required. Belleville washers are known to the art and do not require specific explanation. Other biasing means are also employable with the device of the invention with the joining concept being that the predetermined normal force on the tension member be maintained. One alternate biasing means is a corrugated spring metal sheet 110 which would be placed atop cut side plate 96 in place of washers 102. Sheet 110 has holes 112 for through passage of bolts 100 or studs 52 depending upon location. Holes 112 are preferably slotted to allow for longitudinal expansion of the spring sheet during torquing of fasteners and consequent compression of spring sheet 110.

Figure 14:
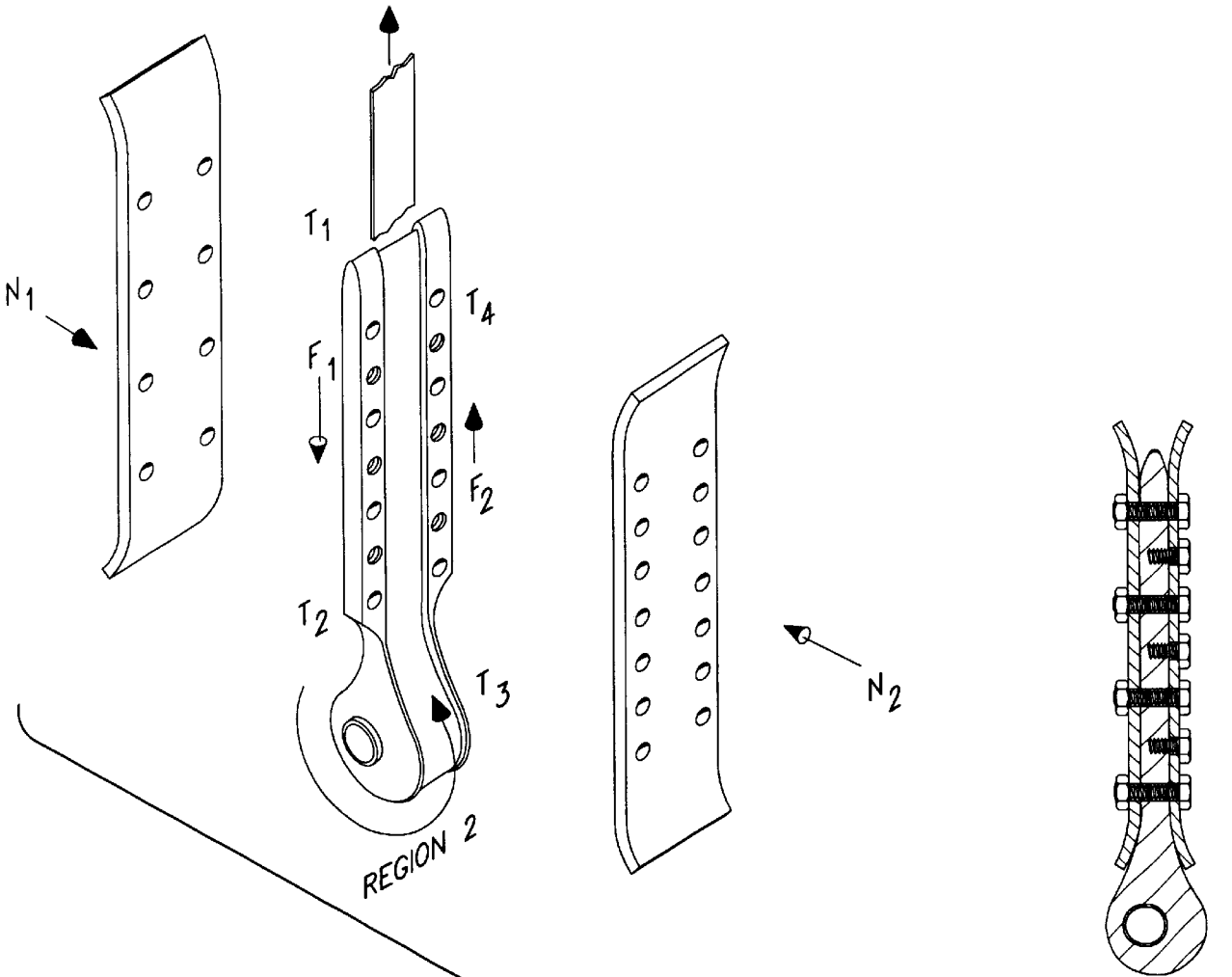
FIG. 14 is a schematic view of the termination device of the invention illustrating force directions for calculations provided herein.

Referring now to FIG. 14, a schematic view of the invention with the plates exploded from the socket and with the forces and tensions required indicated. The invention provides five friction areas which combine to form three friction zones. The areas include: (1) the inside surface of the load side plate which contacts one side of the tension member; (2) the load side of the socket (corresponds to load plate) providing friction on an opposite side of the tension member from the load side plate; (3) the bulbous section which provides a continuous frictional surface on which the tension member is on contact; (4) the cut side of the socket and (5) the cut side plate inside surface, surfaces 4 and 5 being opposed. These five areas create three friction zones that are resolved in the following equations to determine adequacy of the assembly. Each zone is mathematically quantifiable. The sum of the three frictions must be sufficient to prevent slippage. Practically speaking, it is desirable to attain a 100% holding efficiency. In order to achieve this efficiency, the sum of the three friction zones must be equal to or exceed the breaking strength of the tension member being employed. With an assembly having a 100% holding efficiency, the tension member will break before the termination device allows the tension member to slip. In the following equations, several assumptions are made: The rope breaking strength is 30,000 Newtons; the coefficient of friction ($\mu$) for the sand blasted surfaces that are preferred in the invention is 0.25; and the plate normal force is a function of the number of bolts employed multiplied by 1540 Newtons which is the expected force delivered by each bolt. These numbers are exemplary and clearly can be adjusted depending upon circumstances. One of ordinary skill in the art following exposure to this disclosure should be fully capable of adjusting the calculations to conform to any specific parameters given without undue experimentation. FIG. 14 is informative and used in connection with the following formulas employed to determine gripping strength of device 10 and stress in various components.

Suppose Hitch Tension is Divided Into 3 Regions:

$$T_1 \rightarrow T_2 \qquad \text{(Region 1)}$$

$$T_2 - T_3, \qquad \text{(Region 2)}$$

and $$T_3 - T_4 \qquad \text{(Region 3)}$$

we know, $T_1$=flexible flat tension member breaking strength and $T_4$=O, since if $T_4$>O tension member will slip in the termination device For example, Assume Region 1

$T_1$=30,000 N=tension member Breaking Strength $\mu$=0.25=coefficient of friction $$N_1 = \text{Plate normal force}$$

$$= 12{,}320\ N\ (8\ \text{bolts} \times 154ON)$$

for region 1 (referring to FIG. 14) $F_1=\mu N_1$ $F_1=\mu(N_1)$ 2 plates $F_1=\mu 0.25$ (12,320) 2 plates $F_1$=6160N and $$T_2 = T_1 - F_1$$

so $$T_2 = (30{,}000 - 6160)$$

$$= 23{,}840N$$

Region 2

From Traction Theory We Know:

$$\frac{T_2}{T_3} = e^{\mu\theta} \text{ or } T_3 = \frac{T_2}{e^{\mu\theta}}$$

$$T_3 = \frac{23{,}840}{e^{(.25)(\Pi)}} = \frac{23{,}840}{2.291}$$

$T_3$=10,405 N

Region 3

From Previous Calculations, $$T_3=10{,}405 \text{ N}$$

and $T_4$ must be =<0 (values greater than 0 indicate tension member slippage) Cut side plate has 14 fasteners×1540N (the studs 52 are available only to the cut side plate)

Assume $N_2>N_1=21{,}560$ N, and then calculate for slippage $$T_4=T_3-F_2$$

and $$F_2=\mu(N_2)\ 2 \text{ plates}$$

$$F_2=0.25\ (21{,}560)\ 2$$

$$F_2=10{,}780 \text{ N}$$

Criteria $$IF\ F_2 \geqq T_3,$$

design is adequate, tension member will not slip $$F_2>T_3 \text{ ? (YES)}$$

10,780N >10,405N, so design is adequate

PRESSURE ON URETHANE tension member:

EXAMPLE I 125 mm long

Tension member is 30 mm wide $$\text{Pressure} = \frac{N}{A} = \frac{11000\ N}{30 \text{ mm } .125 \text{ mm}}$$

=2.933 MPa=425 psi

In this example the pressure is beyond that taught in the invention

EXAMPLE II

Tension member plates are 190 mm long 30 mm wide

LOAD SIDE $$\text{Pressure} = \frac{N}{A} = \frac{12320N}{30.190} = 2.16\ MPa = \underline{313 \text{ psi}} \text{ (LOAD)}$$

CUT SIDE $$\frac{21560N}{30.190} = 3.78\ MPa\ \underline{548 \text{ psi}} \text{ (CUT)}$$

IN THIS EXAMPLE THE PRESSURE EXERTED ON THE TENSION MEMBER IS ACCEPTABLE FOR BOTH SIDES OF THE TERMINATION DEVICE. THUS, PLATES ARE LONG ENOUGH.

Bolt Torque Calculations (for First Example only):

Example I 125 mm plates with 8 bolts.

LOAD PER BOLT $$N_1=N_2=11{,}000 \text{ N}$$

$$\text{LOAD PER BOLT} = \frac{11{,}000}{8} = 1375N$$

BOLT SIZE/THREADS:

M8–8 mm course thread Pitch=1.25

PROP CLASS 8.8

BOSSARD CATALOG TABLE, PRELOAD TORQUE

| PRELOAD | TORQUE | |
|---|---|---|
| 17,050 $N$ | 24 $N\text{-}M$ | BOSSARD CATALOG |
| So for 1,540 $N$ | $\frac{1540}{17{,}050}(24) = 2.17$ | $N\text{-}M$ |

$$T = 0.2\ Ft\ d$$

$$= 0.2\ (1540)\ 8 = 2.5\ N\text{-}M$$

where Ft=1540N and d=8 mm

PLATE DIMENSIONAL CALCULATIONS $$I\frac{3}{16} \text{ PLATE} = (1 \text{ inch strip}) \quad \frac{1\left(\frac{3}{16}\right)^3}{12} = .0005493\ ''$$

$$5.4931\times10^{-4}$$

$$\Delta = \frac{5\ wl^4}{384\ EI} \qquad I_{\frac{1}{4}} = \frac{1\ (.25)^3}{12} = .001302$$

$$\Delta = \frac{5\ (425)\ (1.653)^4}{384\ (3\times10^7)\ (.0005493)} \quad \underline{1.302\times10^{-3}\ \text{in}^4}$$

$$\Delta = .002507 \text{ in}$$

$$\text{if } \Delta = \frac{Pl^3}{48EI} = \frac{425\ (1.181)\ 1.653^3}{48\ (5.493\times10^{-3})\ (3\times10^7)}$$

$$.002866 \text{ in}\left(\frac{3}{16}\right)$$

$$\sim = \frac{M_C}{I_{\text{Uniform Dist. Load}}} = \frac{[145.159]\frac{.1875}{2}}{.0005493} = -\frac{13.608}{.0005493}$$

$$24{,}774 \text{ psi}$$

$$M \text{ max } \frac{wl^2}{8} \quad \frac{425\ (1.653)^2}{8} = 145.159$$

UNIFORM DIST. LOAD $$\sim\frac{1}{4} = \frac{M_C}{I} = \frac{[145.159]\ [2.50]}{1.302+10^{-3}} = 13{,}935 \text{ psi}$$

Figure 15:
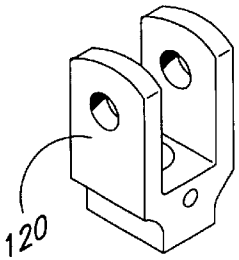
FIG. 15 is a perspective view of the pivot connector of the termination device of the invention.

Referring to FIG. 15, a clevis is illustrated. Clevis 120 is seen connected to the termination assembly in FIG. 2 (in exploded condition). The clevis is conventional and will be easily recognized by one of skill in the art. The clevis 120 is employed to provide a pivot point near a terminal end of the loaded tension member to reduce vibratory fatigue therein. Clevis 120 is connected to socket 30 by pin 122 extending through receptacle 58.

Figure 16:
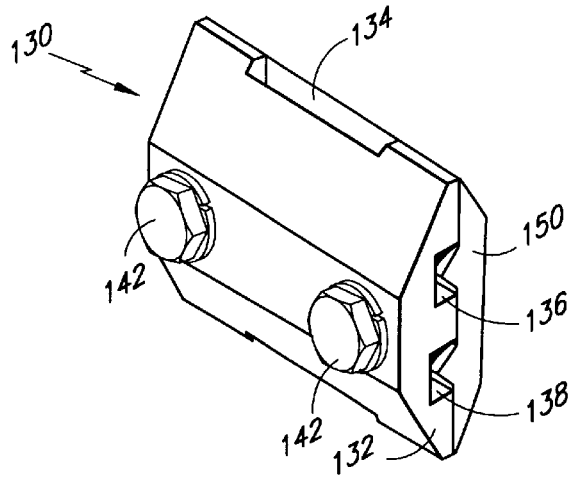
FIG. 16 is a perspective assembled view of the jamming device of the invention.
Figure 17:
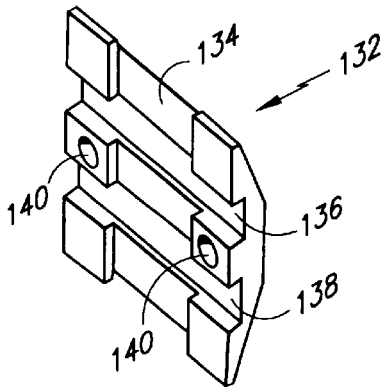
FIG. 17 is a perspective view of the interior portion of one side of the jamming device.
Figure 18:
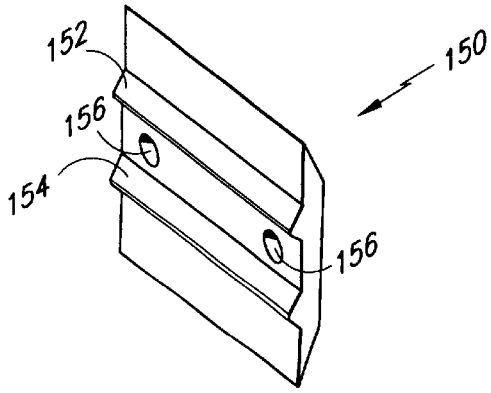
FIG. 18 is a perspective view of the interior portion of a second side of the jamming device.

Referring now to FIGS. 16–18, an optional device 130 for use with the termination device 10 is illustrated. The purpose of device 130 is to jam with termination device 10 in the unlikely event of tension member slippage through device 10. Device 130 is clamped onto the cut end of the tension member somewhere beyond region T4 as discussed above. When engaged with the tension member, device 130 cannot move thereon. Thus, if the tension member slipped it would draw device 130 into contact with cut side plate 96 and side 36 of socket 30 and would jam there preventing further slippage.

Device 130 comprises a female portion 132 (FIG. 17) and a male portion 150 (FIG. 18). Female portion 132 features a tension member groove 134 approximately the thickness of the tension member which is intersected by crimp grooves 136 and 138. Bore holes 140 are provided for through passage of fasteners 142. Male portion 150 provides tension member deformation ridges 152 and 154 which are intended to extend into grooves 136 and 138, respectively upon assembly of device 138. Portion 150 further includes holes 156 which are coaxially with holes 140 when device 130 is assembled to facilitate through passage of assembly bolts 142.

In use, a cut end of a tension member, i.e., the end not being used to support the elevator, is inserted in groove 134 and portion 150 is placed in position. When the bolts 142 are tightened, ridges 152 and 154 force the tension member to follow a tortuous path around the ridges and into grooves 136 and 138. In this way the tension member is prevented from moving relative to device 130 and if device 130 moves into contact with device 10 to tension member slippage, the slippage will be arrested.

While preferred embodiments have been shown and described, various modifications and substitutions may be made thereto without departing from the spirit and scope of invention. Accordingly, it is to be understood that the present invention has beer described by way of illustration and not limitation.

What is claimed is:

1. A tension member termination device for an elevator system comprising:

a socket having a bulbous end, said socket defining a tension member path therearound;

a load side plate affixable to said socket to apply a normal pressure to a load side of an end of a tension member between said socket and said load side plate; and a cut side plate affixable to said socket to apply a normal pressure to a cut side of said end of said tension member between said socket and said cut side plate;

wherein said path defined by said socket includes a surface which is textured to increase the coefficient of friction thereof.

2. A tension member termination device for an elevator system as claimed in claim 1 wherein said surface is sand blasted.

3. A tension member termination device for an elevator system as claimed in claim 1 wherein said load side plate and said cut side plates are affixed to said socket by a plurality of fasteners common to both plates.

4. A tension member termination device comprising:

a compression member against which a tension member is compressible, said compression member having a load side and a cut side;

a pivot associated with said compression member, said pivot having a center wherein said the center of said pivot is aligned with a tension member in the load said of said compression member.

5. A tension member termination device for an elevator system comprising:

a socket having a bulbous end, said socket defining a tension member path therearound;

a load side plate affixable to said socket to apply a normal pressure to a load side of an end of a tension member between said socket and said load side plate; and a cut side plate affixable to said socket to apply a normal pressure to a cut side of said end of said tension member between said socket and said cut side plate;

wherein said socket further includes studs extending from said socket in a direction to intersect said cut side plate enabling a greater compressive load to be placed upon said cut side plate than said load side plate.

* * * * *

UNITED STATES PATENT AND TRADEMARK OFFICE

CERTIFICATE OF CORRECTION

PATENT NO. : 6,820,726 B1
APPLICATION NO. : 09/218989
DATED : November 23, 2004
INVENTOR(S) : Richard J. Ericson et al.

It is certified that error appears in the above-identified patent and that said Letters Patent is hereby corrected as shown below:

On the cover page, in (75) Inventors:

Please add --Dennis J. Rehmer, Bristol, CT (US)--

Signed and Sealed this

Fourth Day of September, 2007

JON W. DUDAS
*Director of the United States Patent and Trademark Office*